United States Patent [19]

Lubberts

[11] Patent Number: 5,069,436

[45] Date of Patent: Dec. 3, 1991

[54] RECIRCULATING DOCUMENT FEEDER

[75] Inventor: Cor Lubberts, Webster, N.Y.

[73] Assignee: Eastman Kodak Company, Rochester, N.Y.

[21] Appl. No.: 446,832

[22] Filed: Dec. 6, 1989

[51] Int. Cl.[5] ..... B65H 5/22

[52] U.S. Cl. ..... 271/3.1; 271/5; 271/35; 271/186; 271/902

[58] Field of Search ..... 271/3.1, 3, 5, 65, 184, 271/185, 186, 11, 35, 225, 902, 4; 355/319

[56] References Cited

U.S. PATENT DOCUMENTS

| | | | |
|---|---|---|---|
| 116,616 | 7/1871 | Mauger . | |
| 549,283 | 11/1895 | Wendte . | |
| T998,003 | 9/1980 | Jackson . | |
| 1,132,241 | 3/1915 | Cooper . | |
| 1,535,224 | 4/1925 | Harrold . | |
| 2,486,703 | 11/1949 | Bishop . | |
| 3,427,965 | 2/1969 | Turner . | |
| 3,612,677 | 10/1971 | Langdon . | |
| 3,744,791 | 7/1973 | Bongers . | |
| 3,768,406 | 10/1973 | Gutsche et al. . | |
| 3,900,191 | 8/1975 | Westover et al. | 271/3 |
| 4,066,252 | 1/1978 | Wick | 271/3 |
| 4,431,303 | 2/1984 | Hoffman . | |
| 4,455,018 | 6/1984 | Colglazier et al. | 271/265 X |
| 4,469,436 | 9/1984 | Jones et al. | 271/3.1 X |
| 4,786,041 | 11/1988 | Acquaviva et al. | 271/3.1 |
| 4,799,079 | 1/1989 | Ujino et al. | 271/3.1 X |
| 4,869,488 | 9/1989 | Hirota et al. | 271/3.1 |
| 4,881,729 | 11/1989 | Culligan et al. | 271/3.1 |
| 4,884,794 | 12/1989 | Dinatale et al. | 271/3.1 X |
| 4,921,236 | 5/1990 | Saeki et al. | 271/3.1 |

*Primary Examiner*—Robert P. Olszewski
*Assistant Examiner*—Cheryl L. Gastineau
*Attorney, Agent, or Firm*—Lawrence P. Kessler

[57] ABSTRACT

A recirculating document feeder for use with an electrostatographic apparatus for producing precollated or post-collated simplex or duplex copies from simplex or duplex original documents with a transport arrangement which simplifies operational control over the feeder and reduces the potential of damage to the original document sheets. The document feeder comprises a hopper for holding a stack of original document sheets. A transport mechanism is provided for respectively transporting an original document sheet along a path in which such sheet is removed in one direction from the stack hopper and delivered in such direction to an exposure station; or a path in which such sheet is removed in a direction opposite to the one direction from the stack hopper, turned over, and delivered to the exposure station. The transport mechanism is selectively controlled to carry out delivery of document sheets depending upon whether the original documents in the stack hopper are simplex or duplex. Further, an original document sheet is selectively clamped to a transport mechanism at the exposure station for recirculation or passed directly back to the hopper to respectively carry out pre-collation or post-collation copying.

8 Claims, 5 Drawing Sheets

T1
T2
T4
12a
O
P1
P2
P3
P4
P5
16
34
40

RECIRCULATING DOCUMENT FEEDER

BACKGROUND OF THE INVENTION

This invention relates in general to recirculating document feeders, and more particularly to a recirculating document feeder for use with an electrostatographic apparatus for producing precollated or post-collated simplex or duplex copies from simplex or duplex original documents.

Electrostatographic reproduction apparatus typically produce copies of original information on receiver members, such as cut sheets of plain bond paper for example. Such information may be formed on one side of a receiver sheet (referred to as a simplex copy) or on both sides of a receiver sheet (referred to as a duplex copy). In certain commercial reproduction apparatus capable of producing duplex copies, selected information is electrostatographically reproduced sequentially on the first sides of respective receiver sheets which are thereafter collected in an intermediate tray. Such sheets are then transported sequentially from the intermediate tray back through the apparatus where other selected information is reproduced respectively on the second sides of such sheets. This reproduction procedure is commonly referred to as "two-pass" duplex copying.

A recirculating document feeder for use with an electrostatographic reproduction apparatus capable of making pre-collated or post-collated simplex or "two-pass" duplex copies from simplex or duplex original documents is shown in U.S. Pat. No. 4,712,214 (issued Dec. 22, 1987, in the name of Randall). While such feeder represents a significant advancement over prior recirculating feeders, it requires accurate control over the operation of diverters necessary to direct the original documents in appropriate paths to accomplish the various desired modes of operation. Moreover, the document turnover mechanism subjects the document sheets to a degree of handling which can potentially damage the sheets. Since the document sheets are often fragile originals, such potential damage must be avoided if at all possible.

SUMMARY OF THE INVENTION

This invention is directed to a recirculating document feeder for use with an electrostatographic apparatus for producing pre-collated or post-collated simplex or duplex copies from simplex or duplex original documents with a transport arrangement which simplifies operational control over the feeder and reduces the potential of damage to the original document sheets. The document feeder comprises a hopper for holding a stack of original document sheets. A first transport mechanism is provided for transporting an original document sheet along a first path relative to an exposure station. A second and third transport mechanism are provided for respectively transporting an original document sheet along a second path in which such sheet is removed in one direction from the stack hopper and delivered in such direction to the first transport mechanism; or a third path in which such sheet is removed in a direction opposite to the one direction from the stack hopper, turned over, and delivered to the first transport mechanism. A fourth transport mechanism is provided for transporting an original document sheet along a path from the first transport mechanism back to the stack hopper. The second or third transport mechanisms are selectively controlled to carry out delivery of document sheets depending upon whether the original documents in the stack hopper are simplex or duplex. Further, an original document sheet is selectively clamped to the first transport mechanism for recirculation or passed directly to the fourth transport mechanism to respectively carry out pre-collation or post-collation copying.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
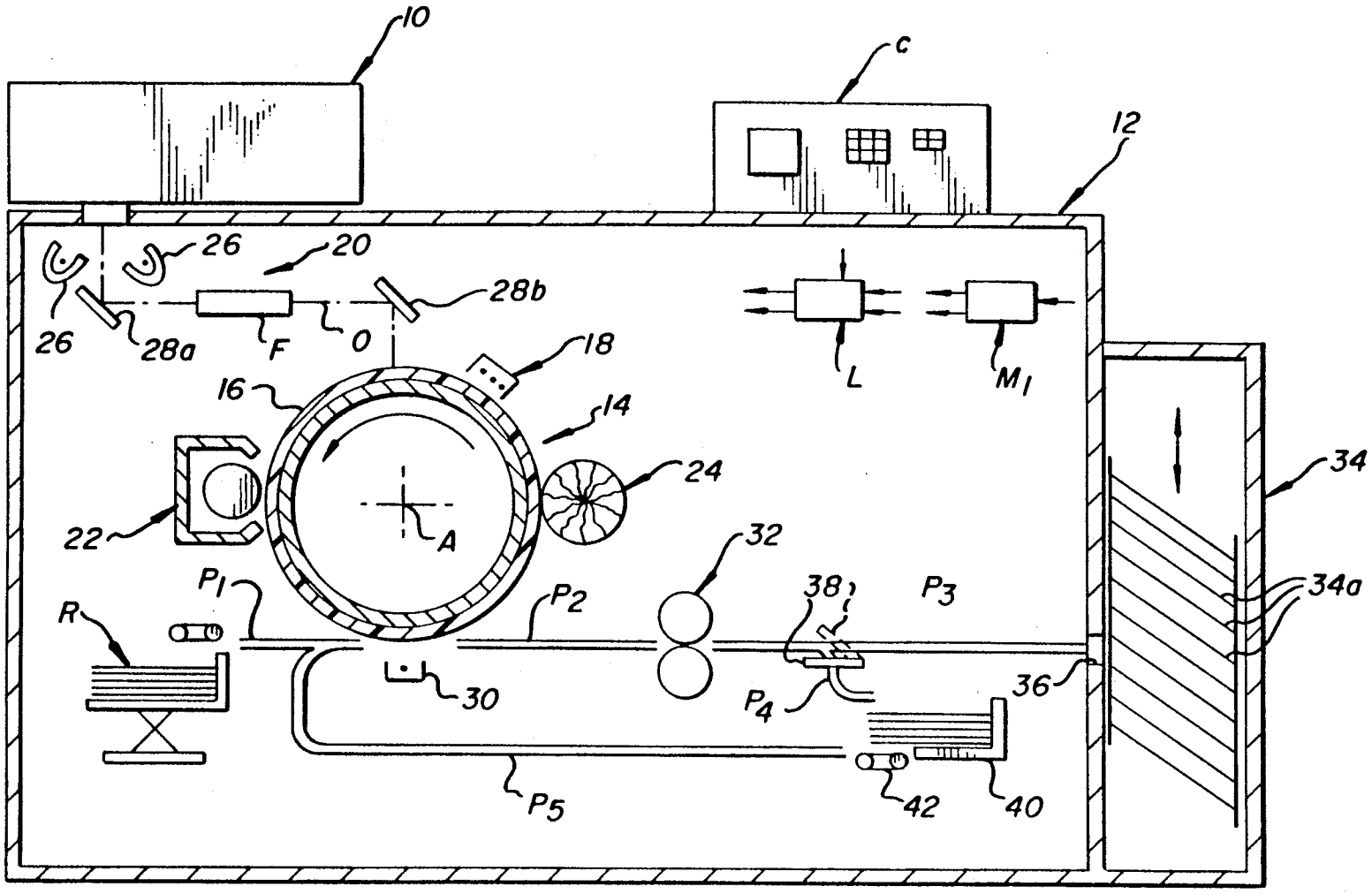
FIG. 1 is a schematic illustration of an exemplary electrostatographic apparatus for use with the recirculating document feeder according to this invention.

Referring now to the accompanying drawings, FIG. 1 shows a recirculating document feeder, according to this invention, generally designated by the numeral 10, in association with an exemplary electrostatographic reproduction apparatus generally designated by the numeral 12. The reproduction apparatus 12 includes a member 14, associated with electrostatographic process stations, upon which marking particle developed, transferable images of original information are formed by the operation of such process stations. While other arrangements of the process stations are suitable for use with this invention, the member 14 is for example a drum 16 mounted in the apparatus 12 for rotation in a counterclockwise direction about its longitudinal axis A. The peripheral surface of the drum 16 has a composite construction including a photoconductive layer and a grounded support layer, such as shown in U.S. Pat. No. 3,615,414 (issued Oct. 26, 1971, in the name of Light), for example. Of course, the member 14 could alternatively comprise a closed loop web formed of similar composite construction. The electrostatographic process stations include a charging apparatus 18, an exposure mechanism 20, a developer apparatus 22, and a cleaning mechanism 24.

Under the control of a logic and control unit L, a motor $M_1$ rotates the drum 16 through operative relation with the electrostatographic process stations. The unit L includes, for example, a microprocessor receiving operator input signals and timing signals based on the angular position of the drum 16 about its axis A. Based on such signals and a program for the microprocessor, the unit L produces signals to control the rotation of the drum 16 and the operation of the various electrostatographic process stations for carrying out the reproduction process. The production of a program for a number of commercially available microprocessors such as INTEL model 8080 or model 8085 microprocessor (which along with others are suitable for use with the invention), is a convention skill well understood in the art. The particular details of any such program would, of course, depend on the architecture of the designated microprocessor.

In the particular operation of the apparatus 12, the motor $M_1$ rotates the drum 16 in a counterclockwise direction to move a portion of the photoconductive layer of its peripheral surface past the charging apparatus 18. The charging apparatus is, for example, a corona charger electrically coupled to a potential source (not shown). The charging apparatus 18 deposits a uniform electrostatic charge on such portion of the drum surface, and such portion then moves past an optical path 0 defined by the exposure mechanism 20. The mechanism 20 includes, lamps 26 which illuminate an original document sheet directed over a transparent platen 12*a* by the feeder 10 in the manner to be explained hereinbelow. A reflected light image of such document sheet is projected along the optical path O in successive line segments via mirror 28*a*, through a fiber optic lens F, and mirrors 28*b*, 28*c*, for example, onto the photoconductive layer of the peripheral surface of the rotating drum 16. Accordingly, such line segments of the reflected light image of the document sheet expose the photoconductive layer and alter the uniform charge pattern thereon to form a charge pattern corresponding to such image. Of course, in other reproduction apparatus suitable for use with this invention, the reflected light image of the document may be projected onto an electronic image scanner, and reduced to electrical signals. Such signals can then be used (directly or in modified form) to drive an exposure source such as a laser or LED array to effect image-wise exposure of the photoconductive layer of drum 16.

After the image-wise charge pattern is formed on the photoconductive layer, the portion of the surface of the drum 16 bearing such pattern is moved into operative relation with the developer apparatus 22. The developer apparatus 22, which may be, for example, a magnetic brush developer of the type described in U.S. Pat. No. 3,457,900 (issued July 29, 1969 in the name of Drexler), brings pigmented marking particles into contact with the photoconductive layer. Such particles adhere to the charge pattern on such layer to develop the pattern into a transferable image. The transferable image is transferred to a receiver sheet, transported from a sheet supply R along a path $P_1$, by an electrostatic transfer field produced, for example, by a charger 30 coupled to a potential source (not shown). After transfer, the portion of the photoconductive layer from which such image was removed is cleaned of any residual marking particles by cleaning mechanism 24 (a rotating fur brush for example) and returned to a location relative to the charging apparatus 18 for reuse. Simultaneously, the receiver sheet bearing the transferred image is transported along a path $P_2$ through a fusing mechanism 32 where the image is fixed thereto by head and/or pressure, for example.

After the image is fixed to the receiver sheet, the sheet is transported along path $P_3$ to an output device 34 for operator retrieval. The output device 34 is, for example, a sorter having a plurality of vertically movable bins 34*a*. The movement of the bins 34*a* is selectively controlled by the unit L, in the manner to be explained more fully hereinbelow, to respectively position the bins relative to an exit slot 36 in the wall of the reproduction apparatus 12 in order to collect receiver sheets from path $P_3$. Of course, other output devices such as fixed bin sorters, for example, are suitable for use with this invention.

The reproduction apparatus 12 is configured to also enable duplex copies to be made. In making duplex copies, receiver sheets bearing a fixed image on one side are diverted from the path $P_3$ into path $P_4$ for collection in an intermediate tray 40. Diversion of such sheets is accomplished, for example, by a diverter 38 pivotable from a first position remote from the path $P_3$ to a second position (phantom line of FIG. 1) to intercept path $P_3$. The receiver sheets collected in tray 40 are fed seriatem from the bottom of the collected stack by a feeder 42 into path $P_5$ and transported along such path back to the transfer charger 30. The path $P_5$ serves to turn the receiver sheets over so that images are respectively received on the opposite side of such sheets from the previously fixed image to form the desired duplex copy.

The recirculating document feeder 10 according to this invention is configured to enable simplex or duplex reproduction of simplex or duplex original document sheets. Moreover, reproductions may be accomplished in a pre-collated mode or a postcollated mode. By pre-collated, it is meant that the reproduction of a multi-sheet document occurs in a sequence where copy-bearing receiver sheets are received at the output device 34 in page sequential order. By post-collated, it is meant that the reproduction of a multi-sheet document occurs in a sequence where copy-bearing receiver sheets of all of a particular page are received at the output device 34 before copy-bearing receiver sheets of a subsequent page are received at the output device.

Figure 2:
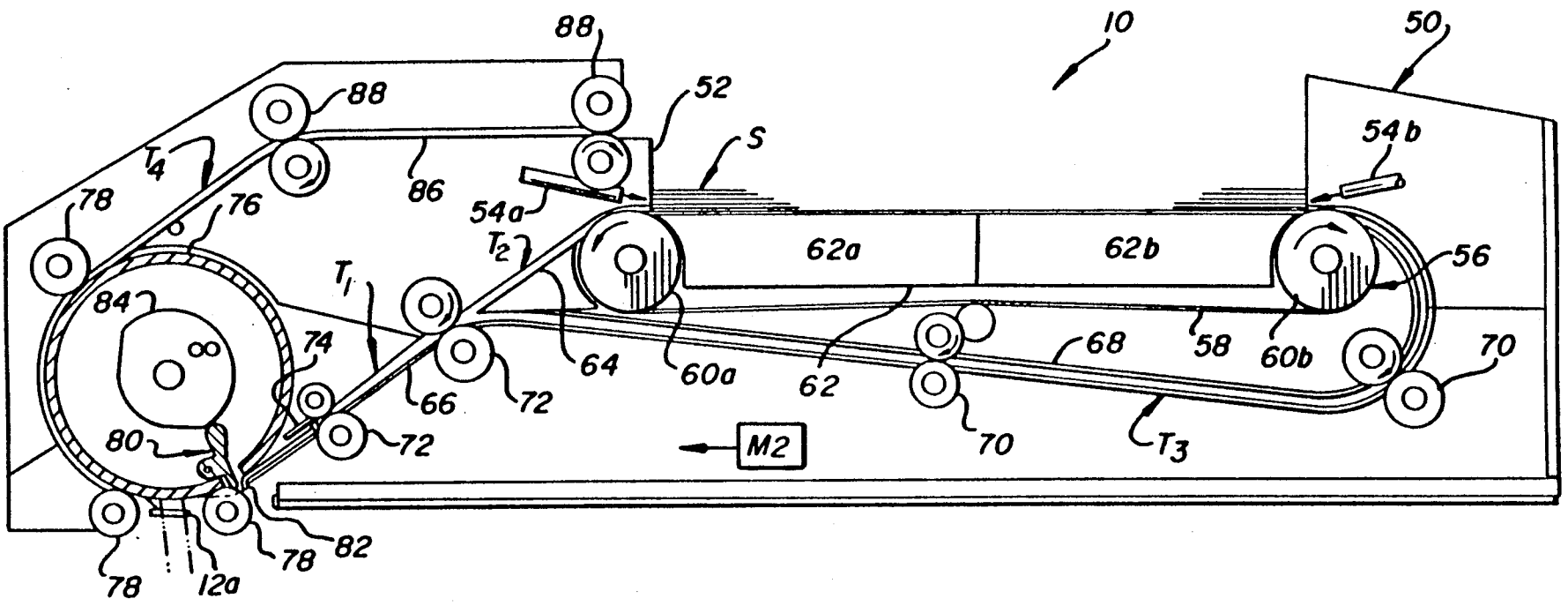
FIG. 2 is a side elevational view, partly in cross-section, on an enlarged scale, of the recirculating document feeder according to this invention.

As best shown in FIG. 2, the feeder 10 includes a housing 50 located adjacent to the top wall of the reproduction apparatus 12 so as to, in part, overlie the transparent platen 12*a*. The housing 50 defines a hopper 52 adapted to hold a stack S of original document sheets to be copied. The side walls of the hopper 52 are adjustable in any well known manner (not shown) in order for the hopper to accommodate and register a range of document sheet sizes. Air jets 54*a*, 54*b* (shown schematically) are associated with the hopper side walls and are directed at the edges of the sheet stack S. If required, the air jets direct a stream of pressurized air at the sheet stack to fluff the stack thereby facilitating the removal of the bottom sheet of the stack.

A feed mechanism 56 is positioned below the hopper 52, and is operatively associated with the original document sheet stack S though the bottom of the hopper. The feed mechanism 56 includes a feed belt 58 entrained about a pair of rollers 60*a*, 60*b*. At least one of the rollers is coupled to a bidirectional drive source such as motor $M_2$ to selectively move the belt 58 in a clockwise closed loop path or a counterclockwise closed loop path. A plenum 62, connected to a vacuum source (not shown), is located between the rollers 60*a*, 60*b* and communicates with the bottom of the stack S so as to tack the bottom most document sheet of the stack to the belt 58. The plenum 62 is divided into two chambers 62*a* and 62*b* associated with the wall of the hopper 52 above roller 60*a* and the wall of the hopper above the roller 60*b* respectively. When vacuum is supplied to the chamber 62*a* and the rollers are driven to move the belt 58 in a counterclockwise direction, the bottom sheet in the stack S is readily removed in the direction to the left in FIG. 2. Conversely, when vacuum is supplied to the chamber 62*b* and the rollers are driven to move the belt 58 in a clockwise direction, the bottom sheet in the stack S is readily removed in the direction to the right in FIG. 2.

A document sheet removed from the stack S to the left enters a path $T_2$ defined by guides 64 and is delivered to a downstream path $T_1$ defined by guides 66 in the same facial orientation as such sheet had when in the stack S. On the other hand, a document sheet removed from the stack S to the right enters a path $T_3$ defined by guides 68 and is delivered to the downstream path $T_1$ in a facial orientation turned over from its orientation when in the stack S. Since the length of the path $T_3$ is longer than the length of the document sheet in the travel direction, the path $T_3$ includes driven nip rollers 70 to urge the sheet along the path. Of course other arrangements for feeding original documents from the hopper 52 either to the left or the right are suitable for use with this invention. For example, two separate unidirectional, independently operable vacuum belt drives may be utilized.

In the travel direction, path $T_1$ includes driven nip rollers 72 which urge a document sheet into registration gate 74. The gate, which is under the control of the logic and control unit L, adjusts the timing of the feed of the document sheet in synchronism with the feed of a receiver sheet in the apparatus 12 so that an image of the information contained on the document sheet can be properly located on the receiver sheet in a manner well known in the art of electrostatographic reproduction. Along the path $T_1$ downstream of the gate 74, there is a rotatable drum 76 cooperating with rotatable backup rollers 78. The drum 76 includes a mechanism 80 for selectively clamping a document sheet to the drum. The mechanism 80 includes a document lead edge clamp 82 which is actuated by a cam 84 for movement to a position for clamping the lead edge of the document sheet to the drum or a position where the document sheet is free to move with the drum and backup rollers 78, but is not clamped to its peripheral surface so that the document sheet is delivered directly into path $T_4$. Path $T_4$ is defined by guides 86 and include driven nip rollers 88 for urging document sheets in such path back into the hopper 52.

The recirculating document feeder 10 according to this invention is capable of functioning under control of the logic and control unit L in cooperation with the reproduction apparatus 12 in the following modes: (1) recirculative feeding of simplex original document sheets to produce pre-collated copies; (2) feeding simplex original document sheets to produce post-collated copies; (3) recirculative feeding of duplex original document sheets to produce pre-collated copies; and (4) feeding duplex original document sheets to produce post-collated copies.

The operation of the recirculating document feeder 10 and the reproduction apparatus 12 in the mode for producing pre-collated copies of simplex original document sheets is as follows: The simplex original document sheets are placed in the tray 52 of the feeder 10 in page sequential order, image side face up. The operator then conditions the logic and control unit L for controlling the feeder 10 and reproduction apparatus 12 by activating appropriate buttons on the control panel C indicative of the desired mode of operation and the number of copies to be made, and thereafter activates the start button. The unit L turns on feed mechanism 56 and activates the output device 34 to position an appropriate bin 34*a* (e.g., top-most bin) adjacent to the exit slot 36. Feed mechanism 56 operates with vacuum connected to plenum 62*b* and the belt 58 driven clockwise. The remainder of the electrostatographic process stations are selectively activated by the unit L as the reproduction cycle is carried out in the above-described manner with the original document sheets being transported seriatem by the feeder 10 across the platen 12*a* to intercept the optical path O of the exposure station 20 to enable copies of such document sheets to be sequentially reproduced. The document sheets are withdrawn from the bottom of the stack S in the tray 52 and directed to the right into path $T_3$.

Figure 3B:
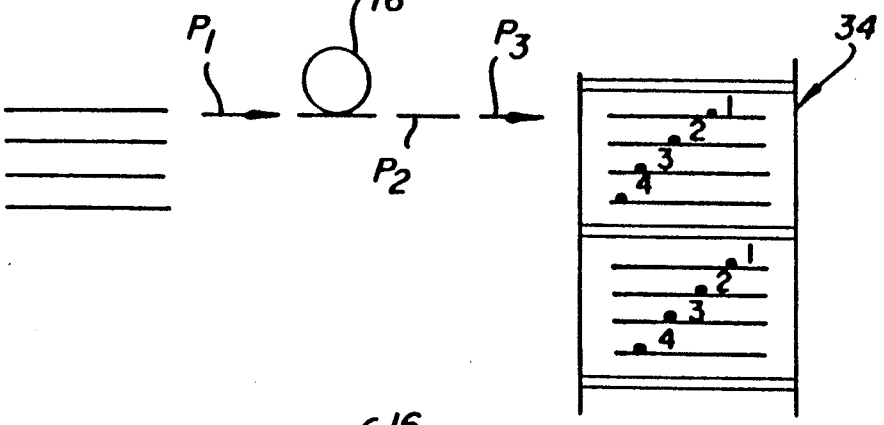
FIG. 3*b* is a schematic illustration depicting the travel path of receiver sheets utilized in the production of pre-collated simplex copies.
Figure 3A:
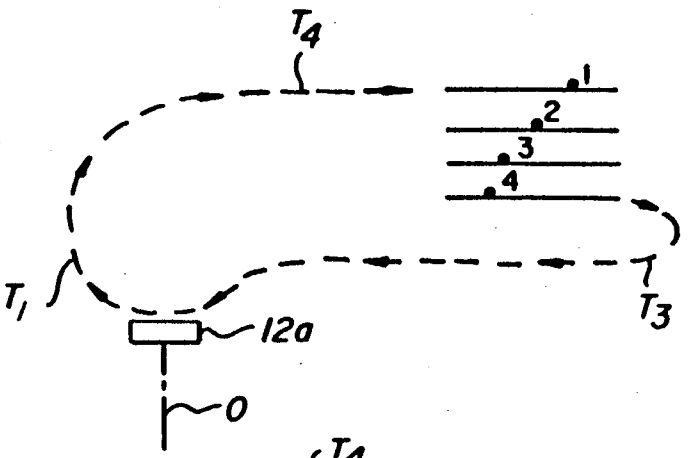
FIG. 3*a* is a schematic illustration depicting the travel path of simplex original document sheets being fed by the recirculating document feeder of FIG. 2 for producing pre-collated simplex copies.

The transport of simplex document sheets utilized to produce pre-collated copies is schematically shown in FIG. 3*a*, with corresponding receiver sheet transport being schematically shown in FIG. 3*b*. The document and receiver sheets in the FIGS. bear the appropriate designations for their respective page numbers in association with the face of such sheets where original information or information copied exists. As can be readily appreciated when viewing FIG. 3*a*, the document sheets are: (1) removed seriatem from the bottom of the sheet stack and transported into path $T_3$ where they are turned over; (2) directed into path $T_1$ where their respective information sides are moved across the platen 12*a* to enable corresponding transferable images to be formed on the drum 16; and (3) returned, in path $T_4$, to the top of the sheet stack, face up. Meanwhile, in synchronism with movement of the images on the drum 16, receiver sheets are transported along paths $P_1$, $P_2$ and $P_3$ to have copies of the document sheets respectively produced thereon, with such copy-bearing receiver sheets being stacked directly in page sequential order (i.e., pre-collated) in each bin 34*a* of the output device 34 (see FIG. 3*b*).

Figure 4B:
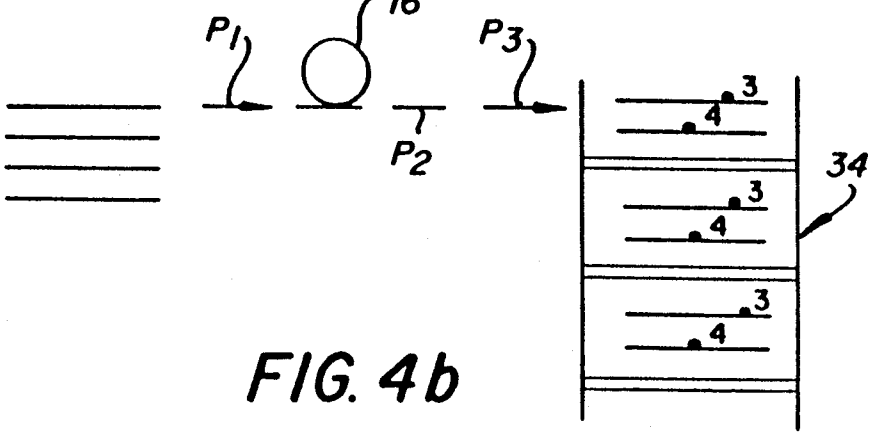
FIG. 4*b* is a schematic illustration depicting the travel path of receiver sheets utilized in the production of post-collated simplex copies.
Figure 4A:
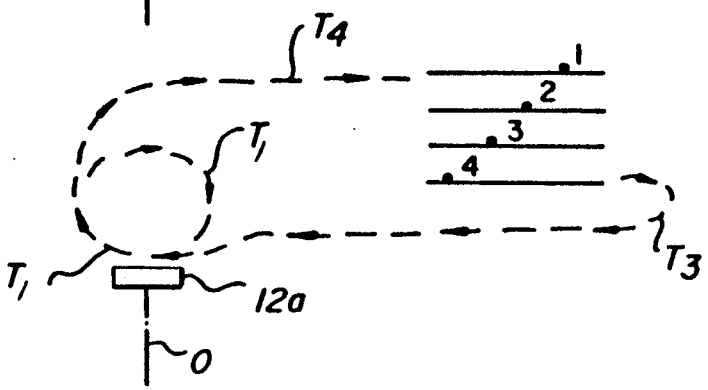
FIG. 4*a* is a schematic illustration depicting the travel path of simplex original document sheets being fed by the recirculating document feeder of FIG. 2 for producing post-collated simplex copies.

When the mode of operation for production of post-collated copies of simplex original document sheets is selected by the operator, the unit L activates the clamping mechanism 80 in proper timed sequence to clamp an original document sheet to the drum 76 on its first circulation about path $T_1$. As a result, such sheet is retained in path $T_1$ and is recirculated across the platen 12*a* for the number of times corresponding to the selected number of desired copies of such sheet (see FIG. 4*a*). Once the lead edge of the sheet has moved across the platen to enable the last of the selected number of copies to be made, the clamping mechanism 80 is deactivated to release the document sheet so that the document sheet is directed from path $T_1$ to path $T_4$ for return to the top of the sheet stack. This cycle is repeated for each document sheet in the stack. By this described recirculation cycle, all of the selected number of copies of a particular document sheet are made prior to any copies being made of a subsequent document sheet. Therefore, receiver sheets bearing the reproduction of a particular document sheet are respectively delivered to separate bins 34*a* of the output device 34 (see FIG. 4*b*) sequentially moving relative to path $P_3$ as described above. Thereafter, receiver sheets respectively bearing the reproduction of subsequent document sheets are respectively similarly delivered to the separate bins so that after all the document sheets have been fed from and returned to the sheet stack, each bin of the output device 34 contains a reproduction of the document sheet stack in page sequential order.

Figures 5A, 5B, 5C, 5D, 6A, 6B:
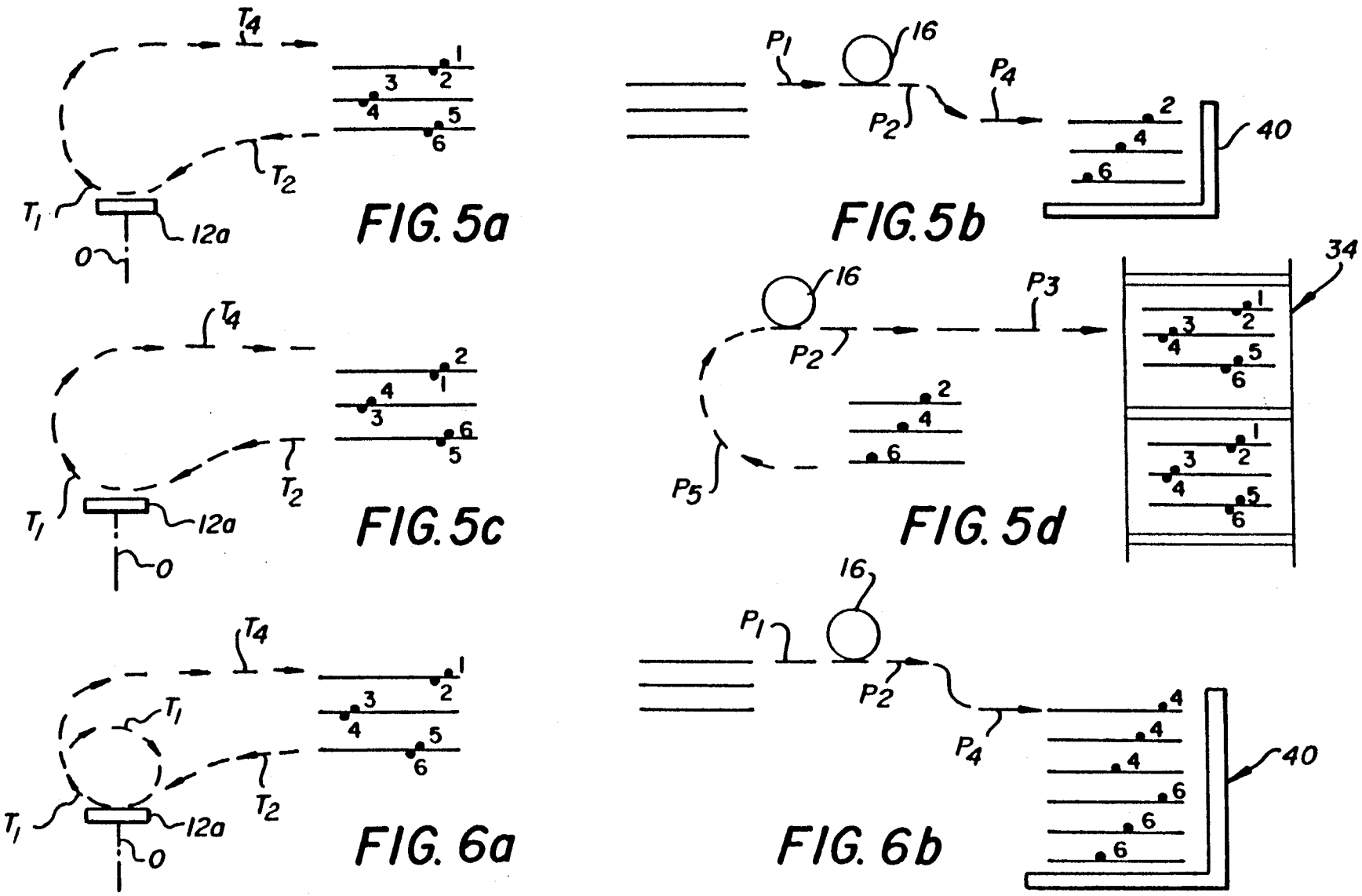
FIGS. 5*a* and 5*c* are schematic views respectively depicting the travel paths of opposite sides of duplex original document sheets being fed by the recirculating document feeder of FIG. 2 for producing pre-collated duplex copies.
FIG. 5*b* is a schematic illustration depicting the travel path of receiver sheets utilized in the production of the first side of pre-collated duplex copies.
FIG. 5*d* is a schematic illustration depicting the travel path of receiver sheets utilized in the production of completed pre-collated duplex copies.
FIGS. 6*a* and 6*c* are schematic views respectively depicting the travel paths of opposite sides of duplex original document sheets being fed by the recirculating document feeder of FIG. 2 for producing post-collated duplex copies.
FIG. 6*b* is a schematic illustration depicting the travel path of receiver sheets utilized in the production of the first side of post-collated duplex copies.
Figure 6D:
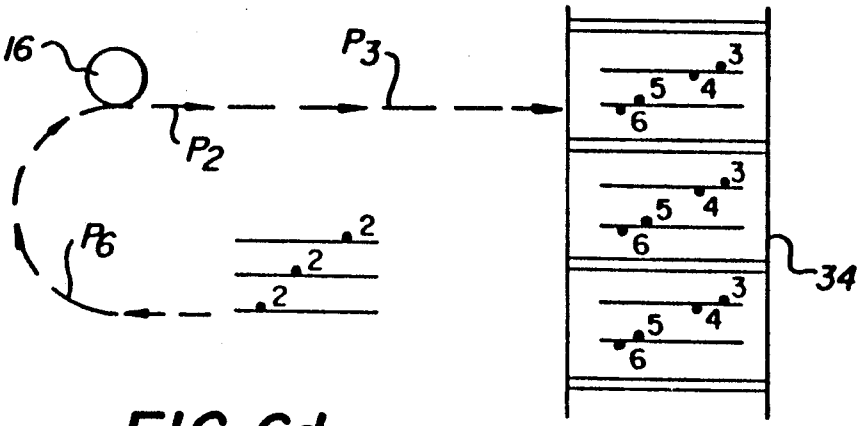
FIG. 6*d* is a schematic illustration depicting the travel path of receiver sheets utilized in the production of completed post-collated duplex copies.
Figure 6C:
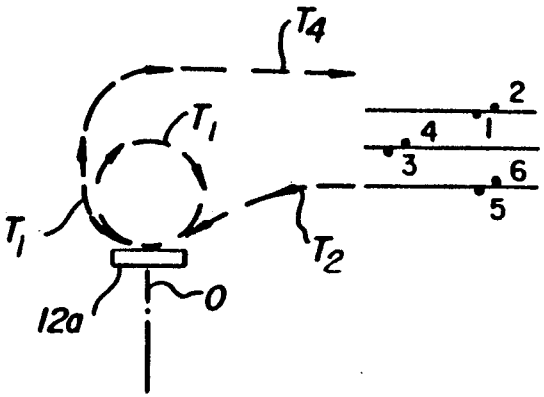

FIGS. 5*a* through 5*d* schematically depict pre-collated reproduction of duplex original document sheets. The duplex original document sheets are placed in the tray 52 of the feeder 10 in page sequential order, first page (odd side) face up. The appropriate buttons on the control panel C are activated to condition the unit L to control the feeder 10 and reproduction apparatus 12 for this desired mode of operation and the desired number of copies to be made, and thereafter the start button is activated. The feed mechanism 56 is activated to operate with vacuum connected to plenum 62*a* and the belt 58 driven counter-clockwise, and diverter 38 is moved to its second position (phantom line position of FIG. 1) to intercept path $P_3$. Accordingly, as shown in FIG. 5*a*, document sheets are: (1) removed seriatem from the bottom of the sheet stack and directed into path $T_2$; (2) moved along path $T_2$ across the platen 12*a* where the information on the even sides of the respective document sheets are exposed to enable corresponding transferable images to be formed on the drum 16; and (3) returned, in path $T_4$ to the top of the sheet stack with the even sides face up. Document sheet transport is then repeated with the odd sides of the document sheets being presented to the exposure mechanism and the sheets returned to the stack with their even sides face up (see FIG. 5*c*). Such alternate presentation of even sides and then odd sides of the document sheets is repeated a number of times equal to the selected number of copies of the document stack to be made.

Meanwhile, in synchronism with the movement of the transferable images of even sides of the document sheets on the drum 16, receiver sheets are transported, as shown in FIG. 5*b*, along paths $P_1$, $P_2$ and $P_4$ to have copies of the even sides of the document sheets produced thereon, with such copybearing receiver sheets being stacked in sequential order in the intermediate tray 40. After the receiver sheet bearing the copy of the last document sheet even side presented to the platen is fed to tray 40, the diverter 38 is moved to its first position (solid line position of FIG. 1). The receiver sheets are then transported seriatem along paths $P_5$, $P_2$ and $P_3$ as described above, in synchronism with the movement of the transferable images of the odd sides of the document sheets on the drum 16 (see FIG. 5*d*) to have copies of the odd sides produced thereon, with the resultant duplex copy-bearing receiver sheets being stacked in a particular bin of the output device 34 directly in page sequential order (i.e., pre-collated). After the receiver sheet bearing the copy of the last odd side presented to the platen is fed to the output device 34, the diverter 38 is moved to its second position, and the receiver sheet transport cycles are alternately repeated the number of times required to produce the selected number of copies of the document stack, each stack copy being stacked in separate bins of the device 34.

Post-collated reproduction of duplex original document sheets is schematically shown in FIGS. 6*a* through 6*d*. For post-collation, the document sheets are transported to and from the sheet stack (see FIGS. 6*a*, 6*c*) in a manner similar to that shown and described with reference to FIGS. 5*a* and 5*c*. However, clamping mechanism 80 is selectively activated to retain each document sheet in the transport path $T_1$ for recirculation relative to the platen 12*a* a number of times equal to the selected number of copies of the document sheet stack to be made, as described with reference to FIG. 4*a*. Further, the receiver sheets are transported to the intermediate tray 40 and thence to the output device 34 (see FIGS. 6*b* and 6*d*) in a manner similar to that shown and described with reference to FIGS. 5*b* and 5*d*. However, the intermediate tray 40 receives all of the even side copy-bearing receiver sheets prior to transport of such sheets to have odd side copies produced thereon. Further the output device 34 functions as shown and described with reference to FIG. 4*b* to deliver respective like duplex receiver sheets (e.g., receiver sheets containing page 6 on one side and page 5 on the opposite side) to separate bins 34*a*. After all the document sheets have been fed from and returned to the document sheet stack, each bin of the output device 34 contains a reproduction of the document sheet stack in page sequential order.

The invention has been described in detail with particular reference to a preferred embodiment thereof, but it will be understood that variations and modifications can be effected within the spirit and scope of the invention.

I claim :

1. A document feeder for recirculating simplex or duplex original document sheets to and from an exposure station of a reproduction apparatus for enabling selective production of pre-collated or post-collated simplex or duplex copies of simplex or duplex original document sheets, said document feeder comprising:

means for holding a stack of original document sheets;

first transport means for transporting an original document sheet along a first path relative to said exposure station;

second transport means for transporting an original document sheet along a second path in which such sheet is removed from said stack holding means in one direction and delivered in such direction to said first transport means;

third transport means for transporting an original document sheet along a third path in which such sheet is removed from said stack holding means in a direction substantially opposite to said one direction, turned over, and delivered to said first transport means;

fourth transport means for transporting an original document sheet along a path from said first transport means to said stack holding means; and control means for selectively actuating said second or third transport means depending upon whether the original documents in said stack holding means are simplex or duplex.

2. The invention of claim 1 further comprising means for selectively clamping an original document sheet to said first transport mechanism for recirculation or passage directly to said fourth transport means in order to respectively carry out pre-collation or post-collation copying.

3. The invention of claim 2 wherein said first transport means includes a rotatable drum, and said selective clamping means includes a gripper and means operatively associated with said gripper for actuating said gripper to clamp the lead edge of a document sheet to the peripheral surface of said drum for rotation therewith.

4. The invention of claim 3 wherein said gripper actuating means comprises a cam.

5. The invention of claim 1 wherein said second transport means includes a belt having at least a run in operative relation with the bottom document sheet in said stack holding means, vacuum means for urging the bottom document sheet into engagement with said belt, and means for moving said belt to remove the bottom document sheet from said stack holding means in said one direction.

6. The invention of claim 1 wherein said third transport means includes a belt having at least a run in operative relation with the bottom document sheet in said stack holding means, vacuum means for urging the bottom document sheet into engagement with said belt, and means for moving said belt to remove the bottom document sheet from said stack holding means in said substantially opposite direction.

7. The invention of claim 1 wherein said second and third transport means include a pair of rollers respectively located substantially immediately below said stack holding means and adjacent to opposite marginal edges of said stack holding means; a closed loop belt entrained about said pair of rollers so as to have a run in operative relation with the bottom document sheet in said stack holding means; vacuum means for urging the bottom document sheet into engagement with said belt, said vacuum means including a first plenum adjacent to one of said rollers and a second plenum adjacent to the other of said rollers; and means for selectively moving said belt in a first direction when vacuum is connected to said first plenum to remove the bottom document sheet from said stack holding means in said one direction, and in a second direction when vacuum is connected to said second plenum to remove the bottom document sheet from said stack holding means in said substantially opposite direction.

8. For use with a reproduction apparatus capable of producing pre-collected or post-collated simplex or duplex copies, a document feeder for recirculating simplex or duplex original document sheets to and from an exposure station of said reprduction apparatus so as to enable selective production of pre-collated or post-collated simplex or duplex copies of simplex or duplex original document sheets, said document feeder comprising:

means for holding a stack of original document sheets;

first transport means for transporting an original document sheet along a first path relative to said exposure station, said first transport means including means for selectively clamping an original document sheet to said first transport mechanism;

second transport means for selectively transporting an original document sheet along a second path in which such sheet is removed from said stack holding means in one direction and delivered in such direction to said first transport means, or transporting an original document sheet along a third path in which such sheet is removed from said stack holding means in a direction substantially opposite to said one direction, turned over, and delivered to said first transport means;

third transport means for transporting an original document sheet along a path from said first transport means to said stack holding means; and control means for selectively actuating said second transport means to remove a document sheet in said first direction or said substantially opposite direction depending upon whether the original document sheets in said stack holding means are simplex or duplex, and for selectively actuating said clamping means for clamping an original document sheet to said first transport mechanism for recirculation or passage directly to said third transport mechanism in order to respectively carry out precollation or post-collation copying.

* * * * *